US010844628B2

(12) United States Patent
Qiu

(10) Patent No.: US 10,844,628 B2
(45) Date of Patent: Nov. 24, 2020

(54) PUSH-PULL PASSAGE LOCK HOUSING

(71) Applicant: CMECH (GUANGZHOU) LTD., Guangzhou (CN)

(72) Inventor: Jia Sen Qiu, Guangzhou (CN)

(73) Assignee: CMECH (GUANGZHOU) LTD., Guangdong (CN)

( * ) Notice: Subject to any disclaimer, the term of this patent is extended or adjusted under 35 U.S.C. 154(b) by 490 days.

(21) Appl. No.: 15/796,352

(22) Filed: Oct. 27, 2017

(65) Prior Publication Data

US 2018/0363322 A1 Dec. 20, 2018

(30) Foreign Application Priority Data

Jun. 19, 2017 (CN) ..... 2017 2 0717217 U

(51) Int. Cl.
*E05B 9/08* (2006.01)
*E05B 9/02* (2006.01)

(52) U.S. Cl.
CPC . *E05B 9/08* (2013.01); *E05B 9/02* (2013.01)

(58) Field of Classification Search
CPC ..... E05B 1/0038; E05B 1/0053; E05B 3/003; E05B 3/04; E05B 3/08; E05B 3/10; E05B 15/0033; E05B 63/22; E05B 9/08; E05B 9/02; E05C 1/14; Y10T 292/57; Y10T 292/93; Y10T 292/96; Y10T 292/0995; Y10T 70/5487; Y10T 70/8324; Y10T 70/8973; Y10S 292/53; Y10S 292/64; Y10S 70/80
USPC ..... 292/336.3, 358, 359, 174, DIG. 53, 292/DIG. 64; 70/488, 443, 466, DIG. 80
See application file for complete search history.

(56) References Cited

U.S. PATENT DOCUMENTS

| | | | | |
|---|---|---|---|---|
| 697,107 A | | 4/1902 | Slafter | |
| 1,442,133 A | * | 1/1923 | Donald | E05C 1/14 70/150 |
| 2,121,530 A | * | 6/1938 | Murphy | E05C 1/14 70/488 |
| 2,124,099 A | * | 7/1938 | Zagrzejewski | E05C 1/14 292/170 |
| 2,383,574 A | * | 8/1945 | Voight | E05C 1/14 292/170 |
| 2,589,405 A | * | 3/1952 | Lang | E05C 1/14 292/170 |

(Continued)

FOREIGN PATENT DOCUMENTS

| | | | | |
|---|---|---|---|---|
| KR | 00921200 B1 | * | 10/2009 | E05C 1/14 |
| KR | 101176797 B1 | * | 8/2012 | E05B 13/105 |

(Continued)

*Primary Examiner* — Christine M Mills
(74) *Attorney, Agent, or Firm* — McKee, Voorhees & Sease, PLC

(57) ABSTRACT

A push-pull passage lock housing comprises upper and lower housings, and first and second connecting components. The upper and lower housings are connected to form a housing with a middle protuberance. The first connecting component is sleeved on the housing and located at one side of the protuberance, while the second connecting component is sleeved on the housing and located at the other side of the protuberance. The first and second connecting components are fastened together. The push-pull passage lock housing facilitates installation and improves assembly efficiency.

20 Claims, 7 Drawing Sheets

(56) References Cited

U.S. PATENT DOCUMENTS 3,385,622 A * 5/1968 Winger ..... E05C 1/14 292/170
3,518,854 A * 7/1970 Krantz ..... E05C 1/14 70/149
3,582,121 A * 6/1971 Rollins ..... E05C 1/12 292/170
3,655,230 A * 4/1972 Armstrong ..... E05C 1/14 292/169
3,785,686 A * 1/1974 Armstrong ..... E05C 1/14 292/336.3
4,629,228 A * 12/1986 Marko ..... E05B 7/00 292/165
4,854,620 A * 8/1989 Dunphy ..... E05B 63/10 292/337
5,516,163 A * 5/1996 Baker ..... E05C 1/14 292/165
5,564,759 A * 10/1996 McNutt ..... E05B 1/0053 292/139
5,983,687 A * 11/1999 Shen ..... E05B 9/08 292/169.22
6,139,072 A * 10/2000 Lee ..... E05B 13/101 292/168
6,196,599 B1 * 3/2001 D'Hooge ..... E05B 7/00 292/165
6,312,026 B1 * 11/2001 Workman ..... E05B 1/0053 292/252
6,540,274 B2 * 4/2003 Bates ..... E05C 1/163 292/169.23
6,568,725 B2 * 5/2003 Furlong ..... E05C 1/163 292/165
6,802,546 B2 * 10/2004 Bates ..... E05B 55/005 292/165
7,950,703 B2 * 5/2011 Marko ..... E05B 63/16 292/336.3
8,087,272 B1 * 1/2012 Korban ..... E05B 13/108 292/337
8,622,444 B2 * 1/2014 Marko ..... E05B 3/00 292/1.5
9,145,719 B2 * 9/2015 Hartford ..... E05C 1/14
9,212,507 B2 * 12/2015 Ou ..... E05B 63/006
9,447,610 B2 * 9/2016 Ou ..... E05B 63/006
9,556,644 B2 * 1/2017 Yoon ..... E05C 1/14
10,240,362 B2 * 3/2019 Ou ..... E05B 13/10
2006/0071484 A1 * 4/2006 Chen ..... E05B 47/068 292/336.3
2007/0096479 A1 * 5/2007 Lin ..... E05B 9/08 292/336.3
2012/0061974 A1 3/2012 Laverty et al.
2014/0047875 A1 * 2/2014 Weathersby ..... E05B 65/06 70/141
2015/0013401 A1 * 1/2015 Yoon ..... E05B 59/00 70/101
2015/0075236 A1 3/2015 Ou et al.
2015/0145266 A1 * 5/2015 Song ..... E05C 1/14 292/336.3
2015/0197968 A1 * 7/2015 Shen ..... E05C 1/14 292/137
2017/0314304 A1 * 11/2017 Nguyen ..... E05B 63/0056
2018/0051485 A1 * 2/2018 Moore ..... E05C 1/14
2018/0058096 A1 * 3/2018 Ou ..... E05B 55/005
2018/0058117 A1 * 3/2018 Ou ..... E05B 7/00
2018/0238081 A1 * 8/2018 Monaghan ..... E05B 63/006
2018/0363329 A1 * 12/2018 Qiu ..... E05B 15/02
2018/0363340 A1 * 12/2018 Qiu ..... E05B 9/08
2019/0136581 A1 * 5/2019 Barker ..... E05B 55/06
2019/0376318 A1 * 12/2019 Cook ..... E05B 55/005

FOREIGN PATENT DOCUMENTS

WO WO-2014038739 A1 * 3/2014 ..... E05B 1/0038
WO WO-2017073817 A1 * 5/2017 ..... E05B 1/00

* cited by examiner (Prioir Art)

PUSH-PULL PASSAGE LOCK HOUSING

CROSS-REFERENCE TO RELATED APPLICATIONS

This application claims priority to Chinese Patent Application No. 201720717217.3, filed Jun. 19, 2017, which is herein incorporated by reference in its entirety.

FIELD OF THE INVENTION

This invention relates to a push-pull passage lock housing having simplified assembly and installation on a door.

BACKGROUND OF THE INVENTION

In the prior art, there are many kinds of door locks, among which a push-pull passage lock is common and widely used. The push-pull passage lock has various structures, generally, it comprises a latch plunger or bolt, a sliding frame connected to the latch bolt and a cam configured inside the sliding frame, wherein the cam rotates and drives the sliding frame to rotate, whereby the latch bolt connected to the sliding frame is driven to retract. A reset spring is arranged to reset the sliding frame. This structure is complicated and has many components, thus it is difficult to assemble. In addition, the failure of the reset spring is likely to occur after a long-term service, and then the latch bolt cannot be inserted into the corresponding hole in the door frame any longer.

FIG. 1 shows a prior art door lock comprising handles 1, at least one lever 2, at least one rotating block 3, a slipping block 4, a latch bolt or plunger 5, and a reset spring 6 for resetting the latch bolt, wherein the lever 2, the rotating block 3 and the slipping block 4 are located inside a housing 7, and the lever 2 and the rotating block 3 both being hinged to the housing 7. One end of the lever 2 is connected to the handle and the other end is adjacent to the rotating block 3. One end of the slipping block 4 is connected to the latch bolt 5 and the other end is adjacent to the rotating block 3. Thus, the lever 2 rotates and drives the rotating block 3 to rotate, whereby the rotating block 3 contacts the slipping block 4 and pushes it up. However, it is still a problem to design a housing which can facilitate installation and improve assembly efficiency and accuracy.

SUMMARY OF THE INVENTION

The present invention provides a push-pull passage lock housing which facilitates installation and improves assembly efficiency.

The present invention provides a technical solution as follows.

A push-pull passage lock housing comprises an upper housing, a lower housing, a first connecting component and a second connecting component, wherein the upper housing and the lower housing are connected to form a housing, and the housing protrudes in its middle to form a protuberance. The first connecting component is sleeved on the housing and is located at one side of the protuberance, and the first connecting component and second connecting component are fastened by screws to each other.

A guide pillar is configured in the lower housing, and a guide hole mated with the guide pillar is configured in the upper housing.

The first connecting component and the second connecting component both comprise a sleeve and a flange configured at one end of the sleeve, wherein the flange of the first connecting component is provided with mounting holes, the flange of the second connecting component is provided with screw holes, and the screws are passed through the mounting holes and are in threaded connection with the screw holes.

The housing is configured with a mounting slot where the screw is arranged.

A first receiving chamber is configured in the lower housing for installing a lever, and the lever can rotate within the first receiving chamber.

The upper housing and the lower housing connect at a connect surface which is in parallel with a direction in which the lever rotates.

Limiting stoppers for restricting the rotation angle of the lever are arranged at the two sidewalls of the first receiving chamber respectively.

A limit chamber is configured in the upper housing to prevent the lever from moving in a vertical direction.

By applying the above-mentioned technical solution, the invention has achieved the following benefits:

(1) The push-pull passage lock housing formed by an upper housing and a lower housing, and the housing is fastened by a first connecting component and a second connecting component sleeved on it. Such push-pull passage lock housing greatly simplifies the assembly procedures, and improves the assembly efficiency and accuracy.

(2) The upper housing and the lower housing can be placed in position and connected through the cooperation between the guide pillar and the guide hole.

(3) A limit chamber is configured in the upper housing to prevent the lever from moving in a vertical direction.

(4) Limiting stoppers are arranged at the two sidewalls of the first receiving chamber respectively to restrict the lever to rotate within a certain angle.

DETAILED DESCRIPTION OF THE PREFERRED EMBODIMENTS

Figure 1:
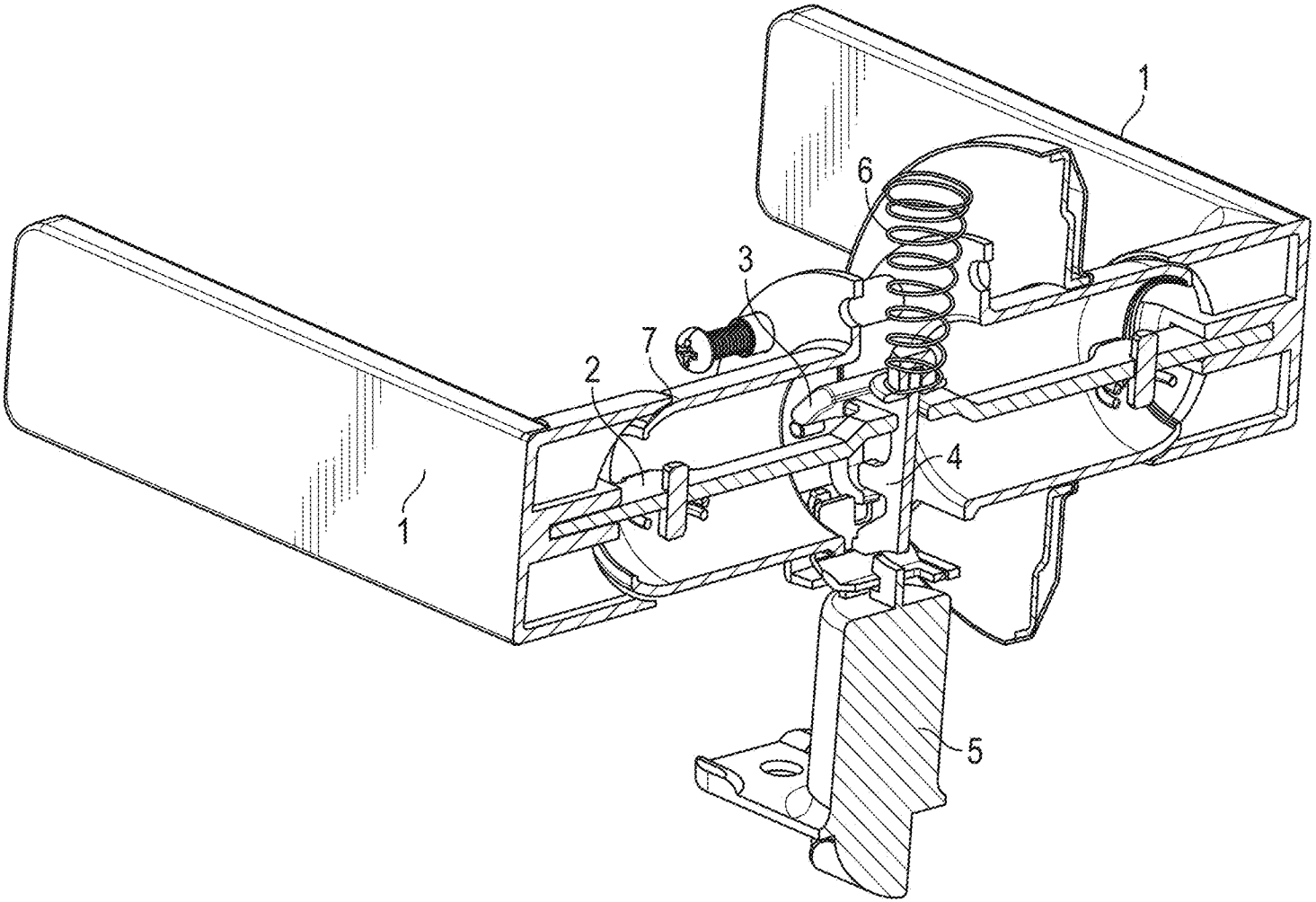
FIG. 1 is a sectional view of a prior art push-pull passage lock, as discussed in the Background.
Figure 2:
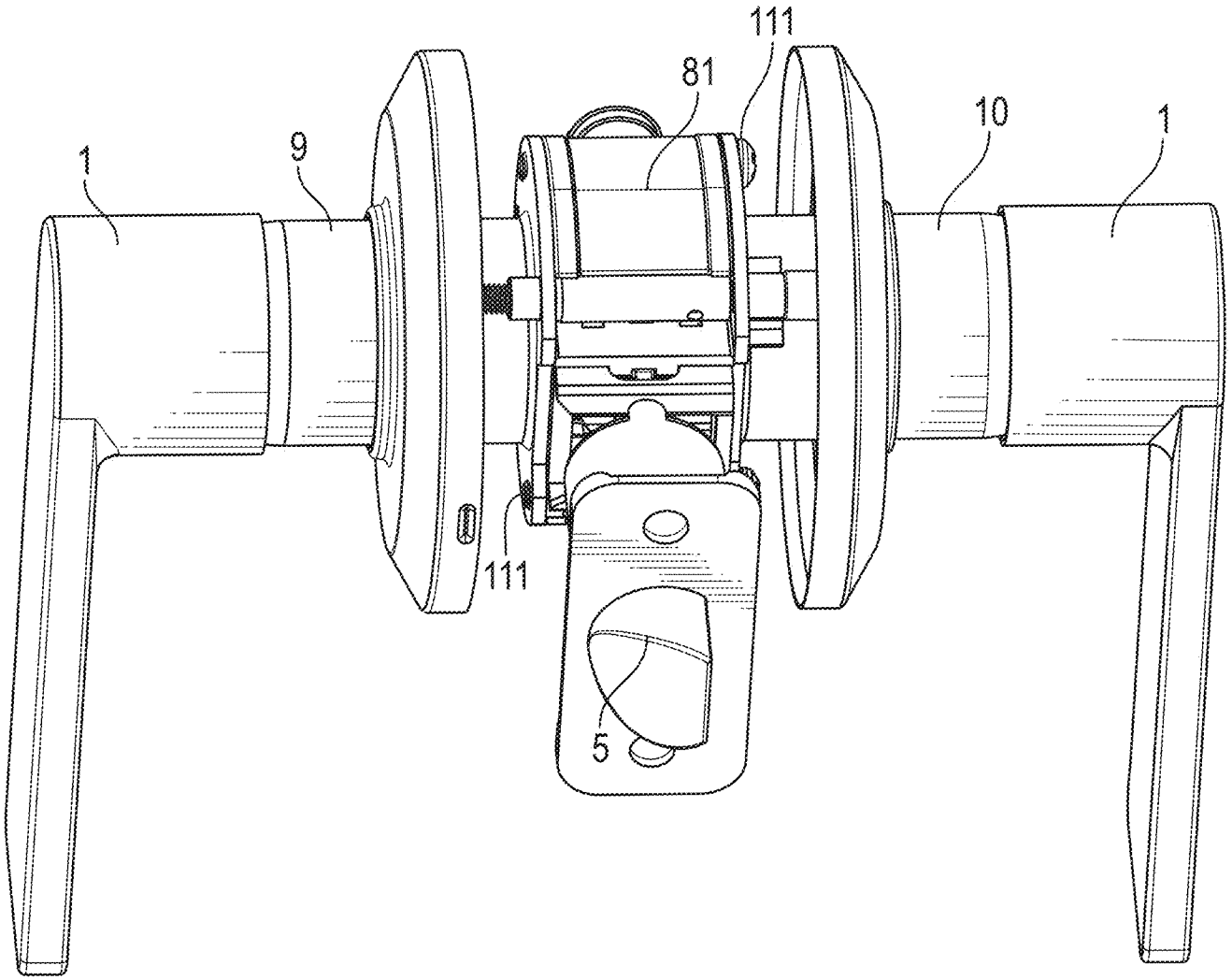
FIG. 2 is a perspective view of the push-pull door lock having the housing of the present invention.
Figure 3:
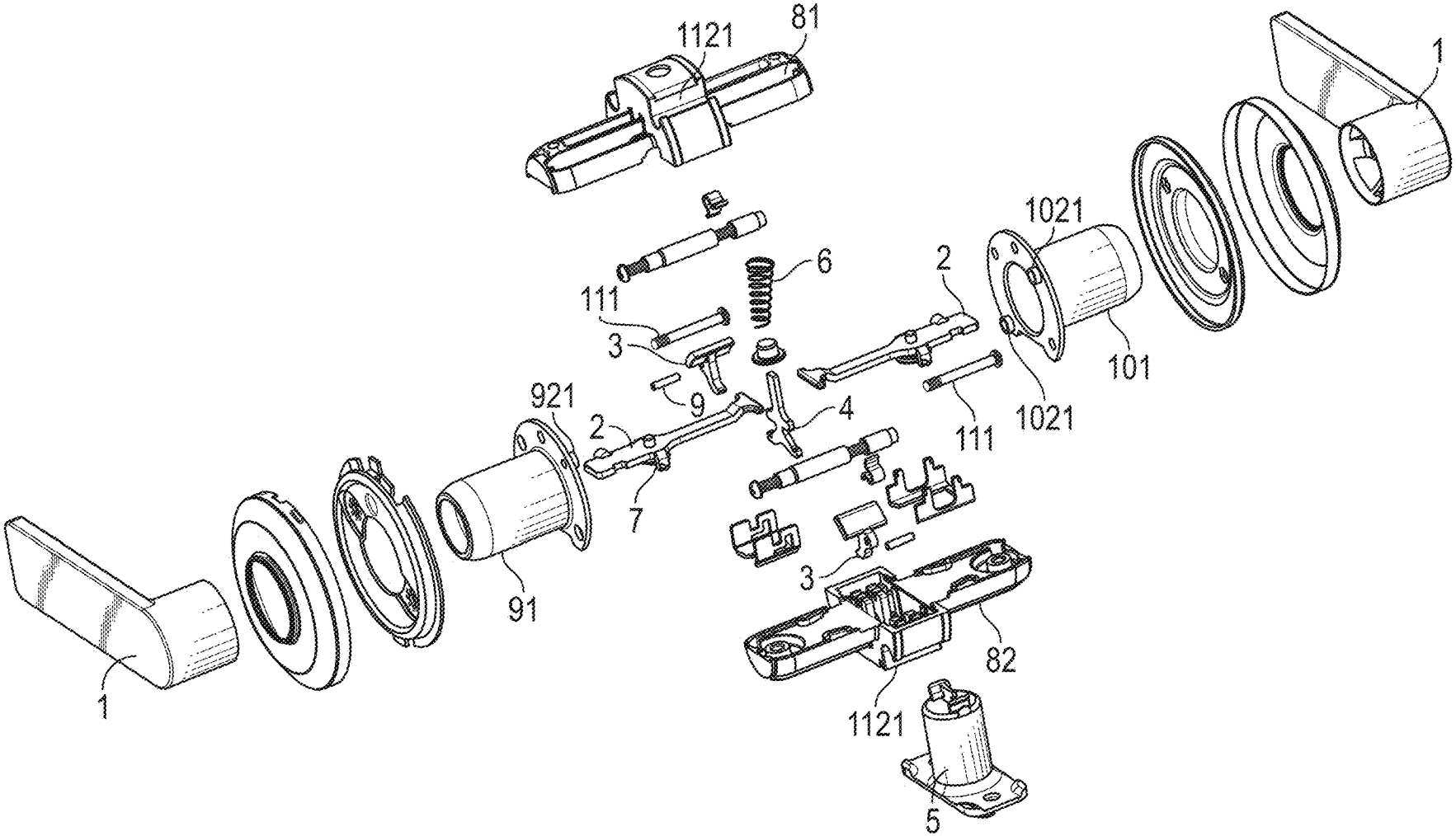
FIG. 3 is an exploded view of the push-pull door lock shown in FIG. 2.

As shown in FIGS. 4-7, this invention provides a push-pull passage lock housing comprising an upper housing 81, a lower housing 82, a first connecting component 9 and a second connecting component 10, wherein the upper housing 81 and the lower housing 82 are connected to form a housing 8, and the housing 8 protrudes in its middle to form a protuberance 83. The first connecting component 9 is sleeved on the housing 8 and is located at one side of the protuberance 83, while the second connecting component 10 is sleeved on the housing 8 is located at one side of the protuberance 83, The first connecting component 9 and second connecting component 10 are fastened to east other by screws 11. During assembly, the first connecting component 9 and the second connecting component 10 are sleeved on the housing 8 respectively, after the upper housing 81 and the lower housing 82 are aligned, and then the first connecting component 9 and the second connecting component 10 are fastened, which greatly simplifies the assembly procedures and improves the assembly efficiency and accuracy.

Figure 5:
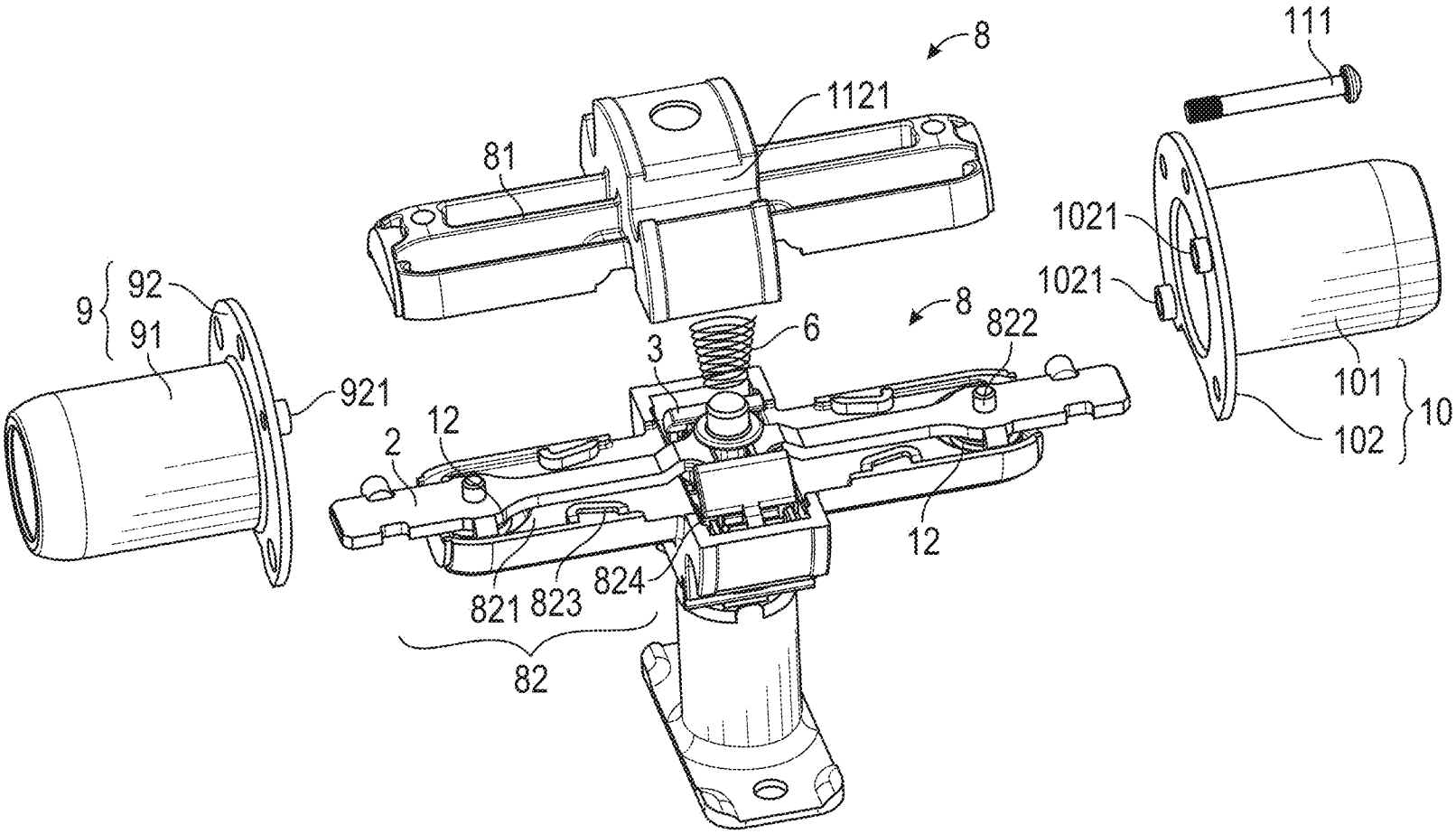
FIG. 5 is a partially exploded view of a push-pull passage lock housing according to the invention.
Figure 6:
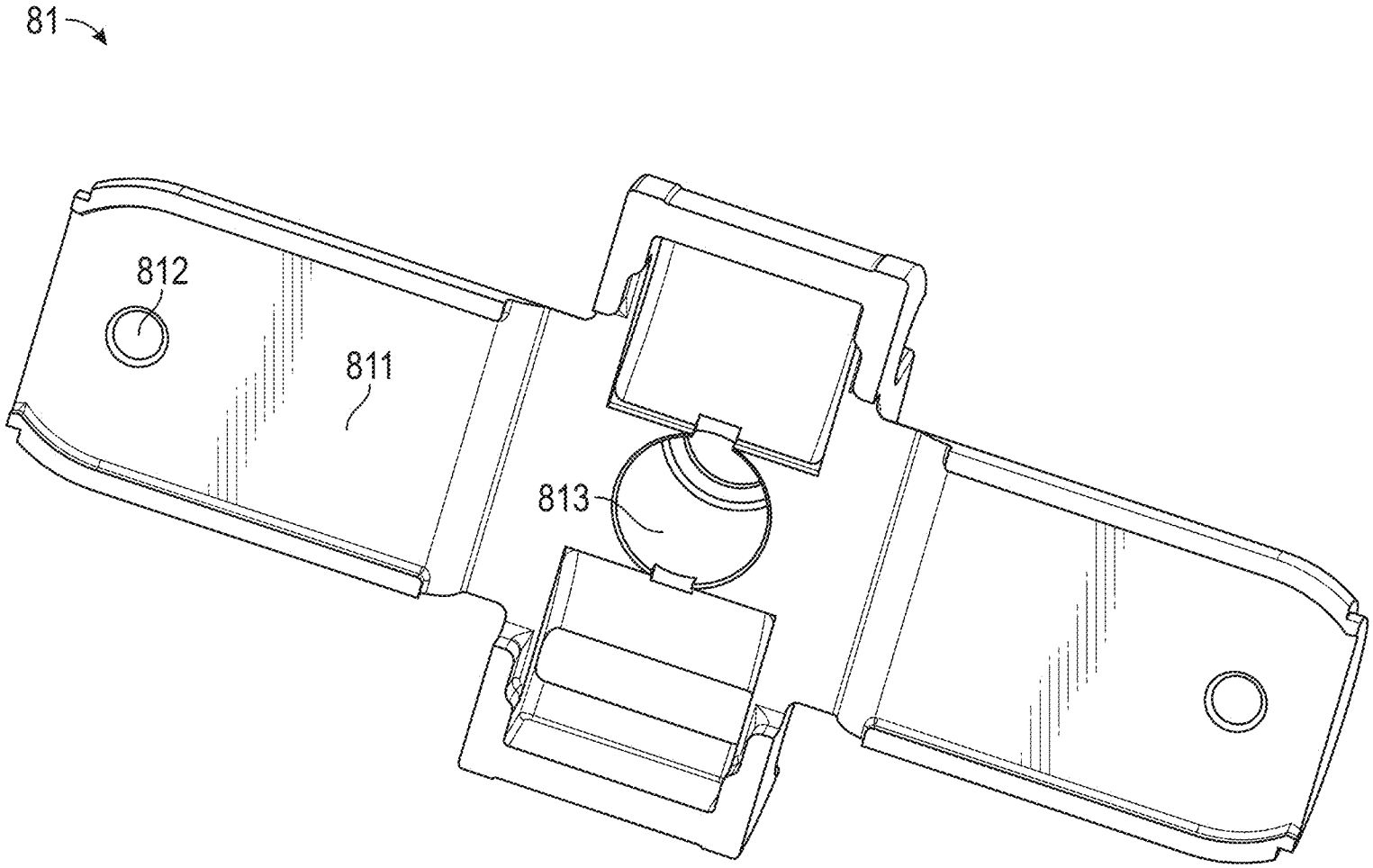
FIG. 6 is a perspective view of an upper housing of a push-pull passage lock housing according to the invention.
Figure 7:
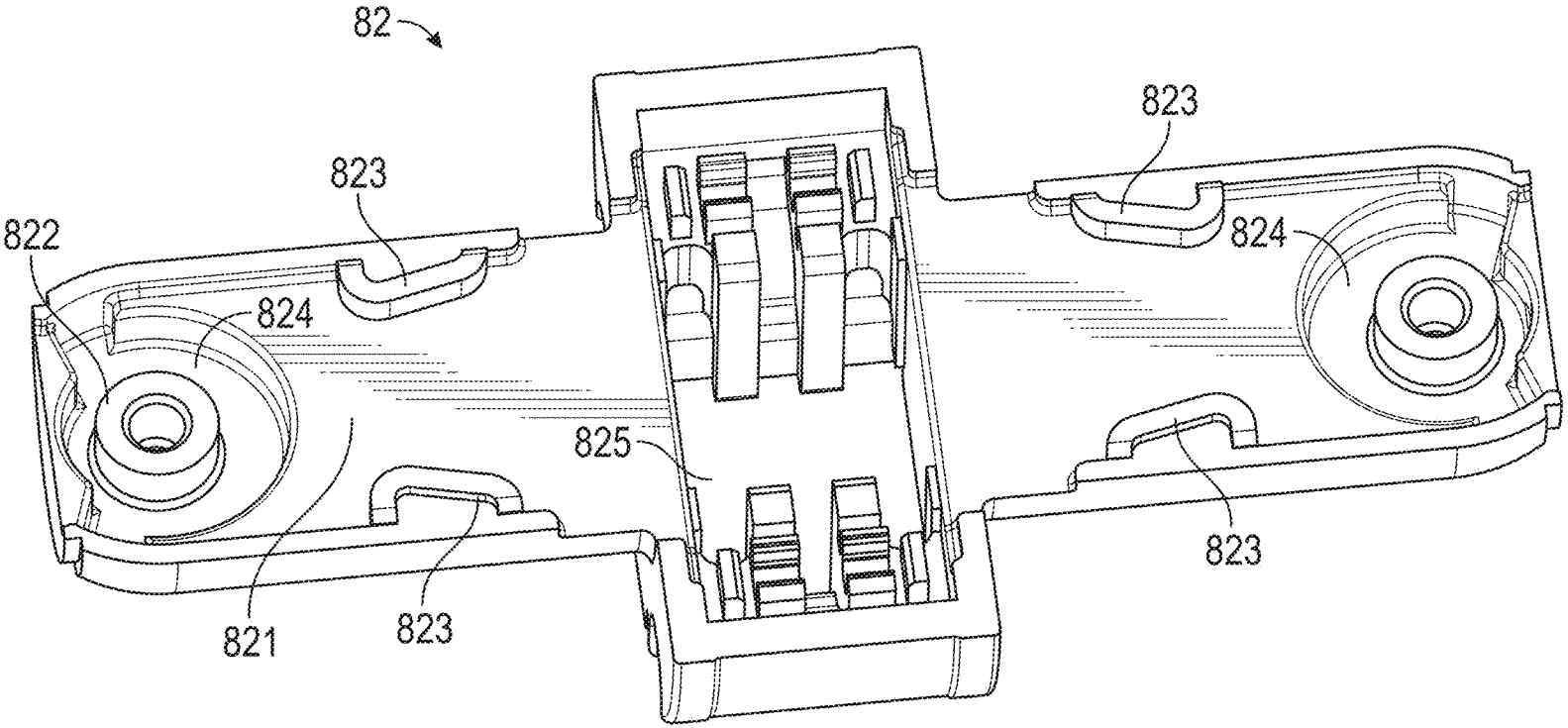
FIG. 7 is a perspective view of a lower housing of a push-pull passage lock housing according to the invention.

As shown in FIGS. 5-7, the housing 8 comprises the upper housing 81 and the lower housing 82, wherein a first receiving chamber 821 is configured in the lower housing 82 for installing a lever 2, and the level 2 can rotate within the first receiving chamber 821. A limit chamber 811 is configured in the upper housing 81 to prevent the lever 2 from moving in a vertical direction. A guide pillar 822 is configured in the first receiving chamber 821, and a guide hole 812 mated with the guide pillar 822 is configured in the limit chamber 811. The lever 2 is installed on the guide pillar 822 and can rotate around the pillar 822. A torsional spring 12 is fastened between the lever 2 and the lower housing 82, is seated in a recess or well 824 in the lower housing, and is sleeved on the guide pillar 822. Limiting stoppers 823 for restricting the rotation angle of lever 2 are arranged at the two sidewalls of the first receiving chamber 821 respectively, so as to prevent a failure of the reset spring 6 due to its super compression in case that the rotation angle of the lever 2 is too large.

The upper housing 81 and the lower housing 82 connect at connection surface which is in parallel with a direction in which the lever 2 rotates, bringing convenience to the assembly. A second receiving chamber 825 for receiving the rotating block and the slipping block 4 is configured in a protruding part of the lower housing 82, while a third receiving chamber 813 for installing the compressed reset spring 6 is configured at a protruding part of the upper housing 81, and the second receiving chamber 825 is disposed opposite to the third receiving chamber 813.

Figure 4:
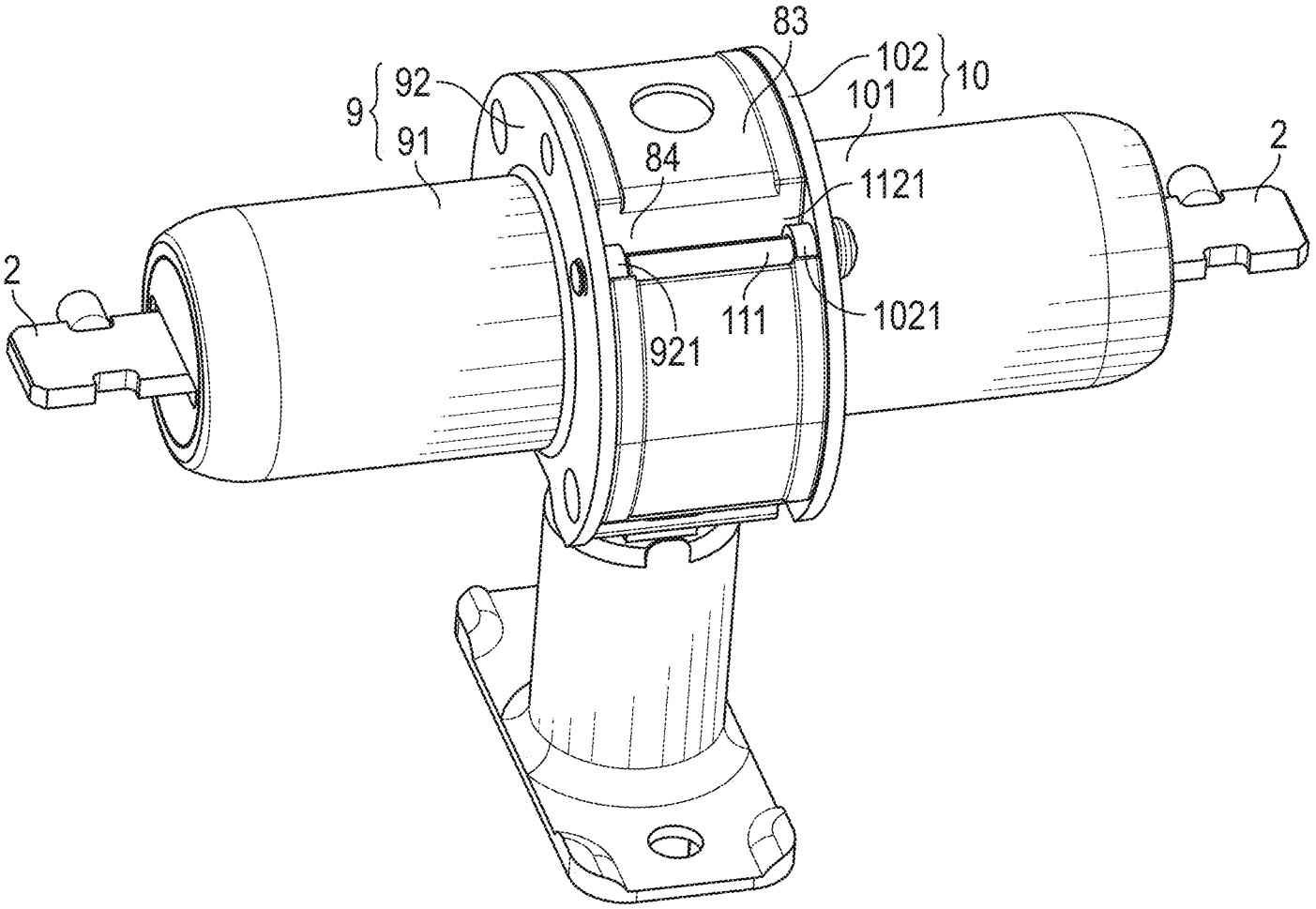
FIG. 4 is a perspective view of a push-pull passage lock housing according to the invention.

As shown in FIGS. 4 and 5, the first connecting component 9 comprises a hollow cylindrical sleeve 91 and a flange 92 configured at one end of the sleeve 91, wherein the flange 92 of the first connecting component 9 is provided with mounting holes 921. The second connecting component 10 also comprises a hollow cylindrical sleeve 101 and a flange 102 configured at one end of the sleeve 101, wherein the flange 102 of the second connecting component 10 is provided with screw holes 1021. Screws 111 pass through the holes 1021 and are in threaded connection with the screw holes 921, so as to tighten the housing 8. The housing 8 is configured with mounting slots 1121 where the screws 111 are arranged.

The push-pull passage lock housing of the present invention has a simple structure and is convenient for the assembly. During the assembly, the upper housing 81 and the lower housing 82 are placed in position and connected through the cooperation between the guide pillar 822 and the guide hole 812. Then the first connecting component 9 and the second connecting component 10 are sleeved at the two sides of the protuberance of the housing respectively and are fastened by the screws 111, thereby the push-pull passage lock housing is assembled. During the disassembly, the whole housing 81, 82 can be disassembled just by removing the screws 111. Therefore, the push-pull passage lock housing of this invention greatly simplifies the assembly and disassembly procedures, improves the assembly efficiency and saves the resources and labor cost.

The push-pull door handle lock assembly of the present invention is further described in concurrently filed application Ser. No. 15/796,102, entitled PUSH-PULL PASSAGE LOCK MOUNTING DEVICE ADAPTED TO DOORS IN VARIOUS SIZES and Ser. No. 15/796,550, entitled PUSH-PULL PASSAGE LOCK, which are incorporated by reference herein in their entireties.

It should be appreciated that the embodiment described hereinbefore is merely preferred embodiment of the present invention and not for purposes of any restrictions or limitations on the invention. Therefore, any simple amendments, equivalent variants and modifications to above embodiments according to the technical essence of the present invention, without departing from the technical solution of the present invention, should be incorporated into ambit of claims of the present invention.

What is claimed is:

1. A push-pull passage lock housing, comprising;
an upper housing with opposite interior and exterior ends;
a lower housing with opposite interior and exterior ends;
an interior connecting component and an exterior connecting component each having a hollow tubular body wherein the respective interior and exterior ends of the upper housing and the lower housing are received within the hollow tubular bodies to hold the upper housing and the lower housing together;
wherein the upper housing and the lower housing are connected to form a housing, and the housing protrudes in its middle to form a protuberance;
the interior connecting component and exterior connecting component being fastened to each other.

2. A push-pull passage lock housing according to claim 1, further comprising a guide pillar in the lower housing, and a guide hole mated with the guide pillar in the upper housing.

3. A push-pull passage lock housing according to claim 1, wherein the interior connecting component and the exterior connecting component both comprise a sleeve and a flange configured at one end of the sleeve; the flange of the interior connecting component is provided with mounting holes, the flange of the exterior connecting component is provided with screw holes; and screws are passed through the screw holes and are in threaded connection with the mounting holes.

4. A push-pull passage lock housing according to claim 1, wherein a first receiving chamber is configured in the lower housing for installing a rotatable lever.

5. A push-pull passage lock housing according to claim 4, wherein the upper housing and the lower housing connect at a connection surface which is parallel with a direction in which the lever rotates.

6. A push-pull passage lock housing according to claim 4, further comprising limiting stoppers arranged at two sidewalls of the first receiving chamber for restricting rotation angle of the lever.

7. A push-pull passage lock housing according to claim 4, further comprising a limit chamber in the upper housing to prevent the lever from moving in a vertical direction.

8. A push-pull passage door lock, comprising:
a retractable plunger;
interior and exterior levers to actuate the plunger;
interior and exterior handles connected to the interior and exterior levers, respectively, to actuate the interior and exterior levers when the interior and exterior handles are pushed and pulled;

upper and lower housings each having opposite interior and exterior ends for receiving the interior and exterior levers respectively;

interior and exterior connectors mounted over the respective interior and exterior ends of the upper and lower housings to hold the upper and lower housings together;

fasteners securing the interior and exterior connectors together;

the interior lever extending beyond the interior connector and toward the interior handle for connection to the interior handle; and the exterior lever extending beyond the exterior connector and toward the exterior handle for connection to the exterior handle.

9. The push-pull passage door lock of claim 8 wherein each of the interior and exterior connectors includes a cylindrical sleeve to fit over the upper and lower housings and a radially extending flange, and the fasteners extend through the radially extending flanges.

10. The push-pull passage door lock of claim 9 wherein one of the upper and lower housings includes a stop to limit rotation of one of the interior and exterior levers.

11. The push-pull passage door lock of claim 9 further comprising interior and exterior guide pins mounted in one of the upper and lower housings, respectively, and upon which the interior and exterior levers are respectively mounted.

12. The push-pull passage door lock of claim 8 wherein the upper and lower housings include slots through which the fasteners extend.

13. The push-pull passage door lock of claim 8 wherein one of the upper and lower housings includes a chamber for receiving the interior and exterior levers.

14. The push-pull passage door lock of claim 13 wherein the other of the upper and lower housings restricts vertical movement of the interior and exterior levers.

15. A method of assembling a push-pull door handle, comprising:

pivotally mounting a pair of levers in opposite interior and exterior ends of a first housing; then enclosing the pair of levers with a second housing having opposite interior and exterior ends; then securing the first housing and the second housing together with interior and exterior-connectors mounted over the respective interior and exterior ends of the first housing and the second housing, with opposite ends of the pair of levers extending outwardly beyond the interior and exterior connectors; and then attaching a pair of handles to the ends of the pair of levers for push and pull actuation of the pair of levers.

16. The method of claim 15 further comprising operatively connecting a retractable plunger to one of the first housing and the second housing and to one of the pair of levers for retraction when either of the pair of handles is pushed or pulled.

17. A passage lock for a door having inside and outside push-pull handles, the passage lock comprising:

a housing with two halves which join to form a chamber;

inner and outer levers received in the chamber and attachable to the inside and outside push-pull handles, respectively;

one of the housing halves including pins for pivotally mounting the inner and outer levers;

each half of the housing having opposite inner and outer ends;

an inner sleeve fit over the inner ends of the housing halves; and an outer sleeve fit over the outer ends of the housing halves.

18. The passage lock of claim 17 wherein the inner sleeve and the outer sleeve each have a substantially closed end with a slot through which one of the inner and outer levers is adapted to extend.

19. The passage lock of claim 17 wherein each housing half has an enlarged middle portion adapted to receive blocks to actuate a plunger connected to the housing.

20. The passage lock of claim 17 wherein one housing half includes a guide pillar and the other housing half includes a guide hole, and the guide pillar and guide hole being aligned.

* * * * *